US006555207B2

(12) United States Patent
Kondo et al.

(10) Patent No.: US 6,555,207 B2
(45) Date of Patent: Apr. 29, 2003

(54) INK-JET RECORDING MATERIAL

(75) Inventors: Noboru Kondo, Tokyo (JP); Teiichi Otani, Tokyo (JP); Atsushi Ono, Tokyo (JP); Hiroyuki Onishi, Nagano-ken (JP); Masaya Shibatani, Nagano-ken (JP)

(73) Assignees: Nippon Paper Industries Co., Ltd. (JP); Seiko Epson Corporation (JP)

( * ) Notice: Subject to any disclaimer, the term of this patent is extended or adjusted under 35 U.S.C. 154(b) by 54 days.

(21) Appl. No.: 09/773,520

(22) Filed: Feb. 2, 2001

(65) Prior Publication Data

US 2002/0039639 A1 Apr. 4, 2002

(30) Foreign Application Priority Data

Feb. 3, 2000 (JP) ..... 2000-025981

(51) Int. Cl.[7] ..... B41M 5/00
(52) U.S. Cl. ..... 428/195; 427/146
(58) Field of Search ..... 428/195, 409; 427/146

(56) References Cited

U.S. PATENT DOCUMENTS 4,542,059 A 9/1985 Toganoh et al.

FOREIGN PATENT DOCUMENTS

| | | |
|---|---|---|
| EP | 0 582 466 | 2/1994 |
| EP | 0 634 285 | 1/1995 |

*Primary Examiner*—Bruce H. Hess
(74) *Attorney, Agent, or Firm*—Millen, White, Zelano & Branigan, P.C.

(57) ABSTRACT

An ink-jet recording material having on at least one surface of a base paper at least one ink-receiving layer comprising pigment and binder, with the ink-receiving layer having a rough texture specified by a surface roughness of at least 9.0 $\mu$m when measured with a PARKER PRINT-SURF measurement device (PPS) under a soft packing condition of 5 kgf/cm$^2$, a surface roughness of at least 7.0 $\mu$m when measured with PPS under a soft packing condition of 10 kgf/cm$^2$, a center-line average roughness (Ra) of at least 3.0 $\mu$m and an Oken-type smoothness of at most 30 seconds, thereby creating an atmosphere of paintings or calligraphic works in the images printed thereon.

18 Claims, No Drawings

INK-JET RECORDING MATERIAL

FIELD OF THE INVENTION

The present invention relates to an ink-jet recording material characterized by its rough texture. More specifically, the invention is concerned with a recording material that is rough in texture and highly suitable for ink-jet recording methods using pigment ink as well as dye ink.

BACKGROUND OF THE INVENTION

The ink-jet recording method is a recording method of forming ink images on a recording material by directing jets of ink drops at the recording material by the use of various techniques. This recording method enables high-speed and full-color printing to be easily achieved with a low noise level. In recent years, therefore, the utilization of ink-jet recording method has been spreading at a rapid rate.

In the field of ink-jet recording, it has so far been preferred to use recording sheets having high smoothness, and so the recording sheets hitherto developed have high smoothness and glossiness comparable to those of photographic paper used for silver-salt photography. On the other hand, as in the cases of oil paintings, watercolor paintings and Japanese-style paintings and calligraphic works, images are drawn or painted on recording materials having low glossiness and rough texture (such as drawing paper, high-quality paperboard and Japanese writing paper), and thereby they can create their individual textures and tastes. However, it was impossible to reproduce such images by ink-jet recording processes without spoiling their original textures and tastes so far as highly smooth recording sheets hitherto developed were used.

The ink used for an ink-jet recording method generally contains a large amount of solvent, and so the recording materials to undergo ink-jet recording are required to have high ink absorbency. For imparting high ink absorbency to recording materials, it has commonly been carried out to provide an ink-absorbing layer on a support. When the support used is a recording material having a rough texture, such as drawing paper, high-quality paperboard or Japanese writing paper, and an ink-receiving layer having a sufficient ink absorption is provided thereon, the features of such a support material, inclusive of a rough texture and a low smoothness, are lost. Therefore, the recording material provided with such an ink-receiving layer has a problem of being unsuitable for the purpose of reproducing originals having a rough texture, such as oil paintings, watercolor paintings, Japanese-style paintings and calligraphic works.

In many cases, such originals as oil paintings, watercolor paintings, Japanese-style paintings and calligraphic works are displayed for interior or exterior decoration. Therefore, when it is aimed to reproduce paintings of the foregoing types and calligraphic works by the ink-jet recording process, recording materials are required to ensure not only high-density colors and excellent color reproduction but also high resistance to light and water in the images recorded.

In full-color inkjet recording, clear images are obtained mainly by the use of the so-called dye ink, which comprises at least three kinds of ink prepared by dissolving dyes of different colors in separate portions of a solvent respectively. This is because dyes used for the ink are superior in point of color reproduction. However, the dye ink has a problem with light resistance and water resistance. On the other hand, the so-called pigment ink lately introduced on the market comprises at least three kinds of ink prepared by dispersing minute-size pigments of different colors as main coloring ingredients into separate portions of a water-based solvent respectively, and so it is superior to the dye ink in light resistance and water resistance, but inferior in color reproduction. In particular, when the printing with pigment ink is made on traditional high-quality recording materials designed placing importance on ink absorption, satisfactory color reproduction cannot be made on such recording materials. Such being the case, it has been wished to develop recording materials capable of delivering both excellent color reproduction and high ink absorption when the pigment ink is used in inkjet recording.

For instance, in compliance with such a wish, Japanese Tokkai Hei 10-119417 (the term "Tokkai" as used herein means an "unexamined published patent application") proposes providing a layer capable of swelling in ink by containing a water-soluble resin on an ink penetration layer containing an inorganic filler. However, such an ink-swellable layer is slow in ink drying speed and tends to cause bleeding of ink dots, and so it has an image formation problem. In addition, multiply paper is disclosed as drawing paper in Japanese Tokkai Hei 9-143900, but the images printed thereon with pigment ink have insufficient color reproduction.

So we have been made intensive studies on recording materials suitable for reproducing paintings having a rough texture and calligraphic works of Japanese style by ink-jet recording processes. As a result, it has been found that good results can be obtained when an ink-receiving layer having a specified surface roughness and smoothness is provided on a base paper having certain surface roughness and smoothness, thereby achieving the invention.

SUMMARY OF THE INVENTION

A first object of the invention is therefore to provide a recording material having a rough texture which can impart the appearance and feel similar to those of oil paintings, watercolor paintings or Japanese-style paintings and calligraphic works to the images reproduced thereon by an ink-jet recording process.

A second object of the invention is to provide an ink-jet recording material which, when full-color printing is done thereon with an ink-jet printer using at least three kinds of ink containing pigments different in color as their respective main coloring ingredients, can absorb the ink in a satisfactory condition, can ensure high resistance to light and water, high color densities and excellent color reproduction in the color images printed, and besides, has suitability for formation of rough-texture images like paintings of various styles and Japanese-style calligraphic works.

The aforementioned objects are attained with an ink-jet recording material having on at least one surface of a base paper at least one ink-receiving layer comprising pigment and binder, with the ink-receiving layer having surface roughness parameters (a), (b) and (c) specified below and an Oken-type smoothness of at most 30 seconds when determined according to Japan TAPPI No. 5:

(a) a surface roughness of at least 9.0 $\mu$m, measured with a PARKER PRINT-SURF measurement device (abbreviated as "PPS" hereinafter) under a soft packing condition of 5 kgf/cm$^2$ according to ISO 8791-4:1992, (b) a surface roughness of at least 7.0 $\mu$m, measured with PPS under a soft packing condition of 10 kgf/cm$^2$ according to ISO 8791-4:1992, and (c) a center-line average roughness (Ra) of at least 3.0 $\mu$m, measured with a stylus-type roughness tester according to JIS B0651.

It is preferable for the foregoing ink-receiving layer to be formed by applying to a base paper a coating composition having a solids concentration of at most 25 weight % and a viscosity of at least 1,000 mPa·s, measured with a Brookfield type viscometer (abbreviated as "B-type viscometer" hereinafter). In particular, it is advantageous to use a base paper having a surface roughness of at least 9.0 μm when measured with PPS under a soft packing condition of 5 kgf/cm$^2$, a surface roughness of at least 7.0 μm when measured with PPS under a soft packing condition of 10 kgf/cm$^2$, a center-line average roughness of at least 3. 0 μm and an Oken-type smoothness of at most 30 seconds.

By incorporating a water-soluble metal salt in the ink-receiving layer in an amount of 0.5 to 10 parts by weight per 100 parts by weight of pigment, the present recording material can provide satisfactory ink absorption and excellent color reproduction, especially in the ink-jet recording with pigment ink. When the water-soluble salt incorporated is at least one salt selected from the group consisting of aluminum salts, magnesium salts, sodium salts, potassium salts and zinc salts, the present recording material can ensure more excellent color reproduction in the images recorded in pigment ink, and besides, the incorporation of such salts is favorable because they can heighten the viscosity of a coating composition to reduce the amounts of other thickeners to be added to the composition.

DETAILED DESCRIPTION OF THE INVENTION

The base paper used in the invention may be any paper as far as the main component thereof is pulp fibers prepared by cooking wood. Specifically, the base paper appropriately used in the invention can be drawing paper, high-quality paperboard, Japanese writing paper or Kraft paper, though it depends on the intended purpose. As the present support, however, drawing paper having high ink absorbency is preferred over the others.

The term "rough texture" as used in the invention means a surface condition that glossiness is absent and minute asperity is present at the surface. Although it is difficult to express "rough texture" numerically, we have found that the combination of measurement of surface roughness under no pressure by the use of a stylus-type roughness tester, measurement with an Oken-type smoothness tester under a weak pressure and measurements with a PARKER PRINT-SURF (PPS) measurement device under variable strong pressures can show a very high correlation with the visual observation result.

The surface of a base paper used in the invention preferably has a roughness of at least 9.0 μm when measured with PPS under a soft packing condition of 5 kgf/cm$^2$, a roughness of at least 7.0 μm when measured with PPS under a soft packing condition of 10 kgf/cm$^2$, a center-line average roughness (Ra) of at least 3.0 μm when measured with a stylus-type roughness tester and an Oken-type smoothness of 30 seconds or below.

To the present recording material, it is advantageous in particular for the surface roughness of a base paper used therein to be from 9.3 to 11.0 μm when measured with PPS under a soft packing condition of 5 kgf/cm$^2$ and be from 7.7 to 10.9 μm when measured with PPS under a soft packing condition of 10 kgf/cm$^2$, for the center-line average roughness of the base paper to be from 3.2 to 9.0 μm when measured with a stylus-type roughness tester and for the Oken-type smoothness of the base paper to be 20 seconds or below.

Additionally, the center-line average roughness values specified above are those measured with a stylus-type roughness tester according to JIS B0651, the Oken-type smoothness values specified above are those measured in accordance with JAPAN TAPPI No.5, and the surface roughness values are those measured with PPS according to ISO 8791-4:1992.

The higher the printer resolution, the lager amount of ink is struck into per-unit area of an ink-receiving layer, and so the greater ink absorption the ink-receiving layer is required to have. On the other hand, the present recording material is required to have a rough texture characterized by specific surface roughness and smoothness values. Therefore, it is favorable for ensuring both high ink absorbency and intended texture that the ink-receiving layer has a coverage ranging from 5 to 25 g/m$^2$, particularly from 6 to 20 g/m$^2$.

When the coverage of ink-receiving layer is smaller than 5 g/m$^2$, the ink-receiving layer can have a rough texture with ease, but the ink absorption thereof becomes poor and thereby the images formed become blurred. More specifically, even when paper having high ink absorbency, such as filter paper, is used as a base paper, the ink absorption speed of the base paper is lower than that of the ink-receiving layer, so that a part of the ink applied remains without being absorbed by the base paper and the ink-receiving layer overflows with ink to markedly cause bleeding in image areas, particularly in image areas of mixed colors. Such undesirable bleeding is serious in the printing with pigment ink. On the other hand, when the ink-receiving layer has a coverage greater than 25 g/m$^2$, it becomes difficult to adjust the texture of the recording material to the desired extent.

Examples of pigments usable in the present ink-receiving layer include precipitated calcium carbonate, ground calcium carbonate, kaolin, clay, talc, titanium dioxide, zinc oxide, zinc carbonate, satin white, magnesium carbonate, magnesium silicate, calcium sulfate, calcium silicate, aluminum-silicate, aluminum hydroxide, alumina sol, colloidal alumina, alumina such as psuedo-boehmite or hydrated alumina, zeolite, silica, and plastic pigments. Of these pigments, synthetic silica is preferably used in the invention.

For securing the desired ink absorption while keeping the coverage of ink-receiving layer within the range in which the intended texture can be acquired, it is favorable to use a pigment having an oil absorption of 100 to 300 cc/100 g.

Examples of a binder usable in the present ink-receiving layer(s) include various kinds of starch, such as oxidized starch, esterified starch, enzyme-denatured starch and cationic starch, proteins such as casein and soybean protein, cellulose derivatives such as carboxymethyl cellulose and hydroxyethyl cellulose, water-soluble high molecular compounds such as polyvinyl alcohols different in saponification degree and derivatives thereof, and water-dispersible high molecular compounds such as acrylic resin emulsions, vinyl acetate resin emulsions, vinylidene chloride resin emulsions, styrene-butadiene latex, acrylonitrile-butadiene latex and a polyester dispersion. Of course, these examples should not be construed as limiting the binders usable in the present ink-receiving layer, but any materials can be employed as the binder as far as they have strong adhesion to base paper and form films after drying. Such binders may be used alone or as amixture of two or more thereof. Additionally, it is advantageous to use polyvinyl alcohol as a binder in a coating composition for ink-receiving layer when the composition is coated with a bar blade coater, because the composition can have improved coating properties.

The suitable amount of binder added, though varies to some extent depending on the kind of a pigment used together, is in the range of 5 to 60 parts by weight, preferably 10 to 50 parts by weight, per 100 parts by weight of pigment. This is because the ink-receiving layer has insufficient surface strength when it contains a binder in an amount smaller than 5 parts by weight, while when the amount of binder added is larger than 60 parts by weight the ink absorption of the resulting layer becomes insufficient.

It is appropriate that the coating composition for forming the present ink-receiving layer containing a pigment and a binder as recited above as main ingredients have a solids concentration of 25 weight % or below and a viscosity of 1,000 mPa·s or above when measured with a B-type viscometer, although the values suitable therefor depend on the kinds of pigment and binder used, the intended coverage of the ink-receiving layer and the coating method adopted. More desirable results can be obtained when the coating composition has a solids concentration of 20 weight % or below and a viscosity of 2,000 mPa·s or above when measured with a B-type viscometer. When the solids concentration is higher than 25 weight % or the viscosity measured with a B-type viscometer is lower than 1,000 mPa·s, the ink-receiving layer formed sometimes fails to have the intended rough texture. Additionally, the viscosity measurement with a Brookfield viscometer is carried out according to JIS K7117.

When the coating composition used is highly viscous, it is difficult for the binder in the composition to penetrate into the base paper; as a result, the ink-receiving layer can be prevented from coming off in powder.

Therefore, it is advantageous for the present ink-receiving layer to be formed using a coating composition having as high viscosity as possible. However, the upper limit of the viscosity of a coating composition depends on the coating apparatus employed. For instance, the upper limit of the viscosity is 5,000 mPa·s in the case of a blade coater. When the viscosity thereof is higher than such a limit, the composition is hard to coat with a blade coater.

It is possible in the invention to control the viscosity of a coating composition by properly choosing the ratio between a pigment and a binder mixed in the coating composition, the molecular weight of the binder used and the addition of thickeners. However, the addition of a water-soluble metal salt to a coating composition is preferred in order to satisfy the conditions desired for the composition. This is because water-soluble metal salts have a thickening effect upon the coating composition and thereby make it easy for the coating composition to satisfy the aforementioned low solids concentration and high viscosity requirements. Further, in the case of printing with pigment ink, those salts produce the effect of fixing the pigment ink to the ink-receiving layer to enable formation of high-density images wherein colors are reproduced in a good condition. Suitable examples of such a water-soluble salt include aluminum salts, magnesium salts, sodium salts, potassium salts and zinc salts. Of these salts, aluminum sulfate, magnesium sulfate, sodium thiosulfate and potassium thiosulfate are preferred over the others. In particular, magnesium sulfate is used to advantage.

Additionally, the addition of aluminum sulfate to the ink-receiving layer tends to cause metallic gloss in printed areas when dye ink is used for recording.

The water-soluble metal salts as recited above are preferably added to the topmost ink-receiving layer of all ink-receiving layers provided on the base paper. The suitable amount of water-soluble salt(s) added is from 0.5 to 10 parts by weight, preferably 1 to 8 parts by weight, per 100 parts by weight of pigment in the topmost ink-receiving layer. When the amount of water-soluble salt(s) incorporated is smaller than 0.5 parts by weight, the water-soluble salt(s) cannot satisfactorily produce the effect thereof. On the other hand, when the amount of water-soluble metal salt(s) added is greater than 10 parts by weight, they may have bad influences upon ink absorption and other characteristics.

Additionally, the term "pigment ink" as used in the invention is intended to include not only unmixed pigment ink but also the so-called dye-pigment ink containing as coloring ingredients at least 50 weight % of pigment and less than 50 weight % of dye.

Pigment particles contained as coloring ingredients in pigment ink have certain sizes. When improvement in ink absorbency of a recording material is made by forming large pores (voids) in its ink-receiving layer, the coloring ingredients penetrate too deeply in the ink-receiving layer. As a result, neither intended color densities nor desired color reproduction can be attained. On the other hand, when the sizes of pores (voids) formed in the ink-receiving layer are reduced with the intention of enhancing color densities, the colored pigments of the ink remain in surface part of the ink-receiving layer to produce favorable effect on color densities. However, the minute pores are filled readily with pigment particles to impede ink absorption, and the colored pigments confined within a very thin surface region of the ink-receiving layer become a cause of lowering rubbing resistance of the recorded images. Therefore, it has so far been difficult to ensure both satisfactory color reproduction and high ink absorption in ink-jet recording with pigment ink. On the other hand, as mentioned above, the incorporation of water-soluble metal salts in an ink-receiving layer enables improvements in both color reproduction and ink absorption.

In addition, various additives, such as an antifoaming agent, a defoaming agent, a pigment dispersing agent, a release agent, a blowing agent, a pH controlling agent, a surface-sizing agent, a coloring dye, a coloring pigment, a fluorescent dye, a UV absorbent, an antioxidant, a light stabilizer, an antiseptic, a waterproof agent, a dye fixing agent, a surfactant and a wet paper strength increasing agent, can be added in appropriate amounts to the ink-receiving layers so far as the addition thereof does not impair the effects of the invention.

The ink-receiving layer(s) can be provided on a support by using a known coating apparatus, such as a blade coater, a roll coater, an air knife coater, a bar coater, a curtain coater, a gravure coater, a gate roll coater and a short dwell coater. As appropriate ranges of viscosity and solids concentration are different from one coater to another, the solids concentration and viscosity of a coating composition used are adjusted for the coater used so as to ensure the desired rough texture on the recording material surface formed.

In the invention, it is preferable to use a blade coater because the ink-receiving layer formed can have higher surface strength. Reasons why the blade coater imparts higher surface strength to the coating surface than the other coaters cannot be explained clearly. However, it can be supposed that, in a blade coating process, the coverage is adjusted by pressing a metal blade or rod against the coating surface after the coating composition is applied to base paper, so that pressure is exerted on the base paper and the coating composition to enhance the adhesion of the ink-receiving layer to the base paper. In addition, the blade coater is well suited for coating highly viscous coating compositions.

While coaters of the type which perform the coverage adjustment under no pressure (e.g., a curtain coater) or weak pressure (e.g., an air knife coater) enable ink-receiving layers to have a rough texture, the ink-receiving layers formed thereby are subject to deterioration in surface strength. Further, these coaters require the coating compositions to have low viscosity, compared with the blade coater. Therefore, the coating compositions are reduced in solids concentration. As a result, the binder component alone becomes easy to penetrate into base paper during the drying process, and the thus formed ink-receiving surface tends to come off in powder.

In addition, calendered finish may be given to the ink-receiving layer surface by using various calenders, such as a machine calender, a super calender and a soft calender, independently or in combination to the extent that the rough texture of the recording material is not impaired thereby.

The entire disclosure of all application, patents and publications, cited above and below, and of corresponding Japanese application No. 2000-025981, filed Feb. 3, 2000, are hereby incorporated by reference.

Now, specific constitutions of recording materials according to the invention are illustrated by reference to the following examples, and characteristics of the present recording materials are explained by putting them in contrast with those of comparative recording materials. However, it should be understood that these examples are not to be construed as limiting the scope of the invention in any way. Unless otherwise noted, all "parts" and all "%" are by weight in the following examples and comparative examples. Additionally, the amounts of hydrated metal salts set forth below are on a anhydrous basis.

The coating composition samples for forming ink-receiving layers are examined for viscosity according to the method defined in JIS K7117. Specifically, the viscosity measurement is carried out using a BM-type Viscometer (a kind of Brookfield type viscometer, made by TOKIMEC Co., Ltd.) and a rotor No.3 or No.4, and adjusting the temperature of each coating composition sample to 23° C. and the rotor revolving speed to 60 r.p.m. After a one-minute lapse from the start of the viscosity measurement, the viscosity value of each sample is determined.

Performance evaluations of ink-jet recording materials prepared in Examples and Comparative Examples respectively are made using the following methods.

(1) Surface Roughness (a) Visual Observation of Texture:

The texture of each recording material sample is observed visually, and evaluated by the following criteria.

◎: Very rough in texture

○: Rough in texture

Δ: Somewhat smooth, but rough in texture

X: Smooth and free of rough texture (b) Surface Roughness Measurements by PPS:

In accordance with the method defined in ISO 8791-4, surface roughness values are measured using a PPS measurement device, PPS-78, made by H. E. MESSMER Co., under the two conditions of 5 kgf/cm$^2$ and 10 kgf/cm$^2$.

(c) Surface Roughness Measurement by Stylus-Type Roughness Tester:

In accordance with the method defined in JIS B0651, center-line average roughness (Ra) is measured using a stylus-type surface roughness tester (Model SE-3C, made by K.K. Kosaka Kenkyusho) under conditions that the cut-off value is 0.8 and the average roughness-measuring distance is 8 mm.

(d) Oken-Type Smoothness Measurement:

Surface smoothness is measured using an Oken-type smoothness tester (Model KY-5, made by Asahi Seiko Co., Ltd.) in accordance with the method defined in Japan TAPPI No. 5.

(2) Recording Tests Using Dye Ink

The recording tests using dye ink are carried out by recording established solid and image patterns on each recording material sample by means of an ink-jet printer, Model PM-770C (trade name, a product of Seiko Epson Corp.), and evaluated by the following criteria.

(a) Color Reproduction:

The black, cyan, magenta and yellow solid patterns are examined for their respective densities by means of a Macbeth densitometer, RD915 (made by Macbeth Co.). Color reproduction of each sample is graded by the sum total of measured values of those color densities.

◎: 6.5 <sum total of measured values

○: 5.8≦sum total of measured values≦6.5

Δ: 5.0≦sum total of measured values<5.8

X: sum total of measured values <5.0

(b) Ink Absorption:

On each sample is printed a pattern made up of areas solidly colored in red (mixture of magenta ink and yellow ink) and those solidly colored in green (mixture of cyan ink and yellow ink) which are arranged so as to border on one another. And the extent of bleed on the borders is evaluated by visual observation according to the following criteria. Additionally, the bleed on the border between red and green areas has a black color, so the observation thereof enables clear-cut evaluation.

◎: Absolutely no bleed is observed on the borders

○: Practically no bleed is observed on the borders

Δ: A little bleed is observed on the borders

X: Considerable bleed is observed on the borders (3) Recording Tests Using Pigment Ink The recording tests using pigment ink are carried out by recording established solid and image patterns on each recording material sample by means of an ink-jet printer, HP DesignJet 2500 CP (made by HEWLETT PACKARD CO.), and evaluated by the following criteria.

(a) Color Reproduction:

The black, cyan, magenta and yellow solid patterns are examined for their respective densities by means of a Macbeth densitometer, RD915 (made by Macbeth Co.). Color reproduction of each sample is graded by the sum total of measured values of those color densities.

◎: 6.0<sum total of measured values

○: 5.0≦sum total of measured values≦6.0

Δ: 4.0≦sum total of measured values<5.0

X: sum total of measured values<4.0

(b) Ink Absorption:

A pattern made up of areas solidly colored in red (mixture of magenta ink and yellow ink) and areas solidly colored in green (mixture of cyan ink and yellow ink) which are arranged so as to border on one another is printed on each sample. And the extent of bleed on the borders is evaluated by visual observation according to the following criteria. Additionally, the bleed on the border between red and green areas has a black color, so the observation thereof enables clear-cut evaluation.

◎: Absolutely no bleed is observed on the borders

○: Practically no bleed is observed on the borders

Δ: A little bleed is observed on the borders

X: Considerable bleed is observed on the borders

EXAMPLE 1

A drawing paper having a basis weight of 180 g/m$^2$, a thickness of 290 μm, a density of 0.62 g/cm$^3$, a surface roughness specified below and an Oken-type smoothness of 2 seconds was used as base paper. The surface roughness of the drawing paper was 10.40 μm when measured with PPS under a soft packing condition of 5 kgf/cm$^2$, 10.00 μm when measured with PPS under a soft packing condition of 10 kgf/cm$^2$, and 4.40 μm in terms of center-line average roughness. On this drawing paper, the following coating composition (1) having a solids concentration of 19 weight % and a viscosity of 2,750 mPa·s when measured with a B-type viscometer (this viscosity is referred simply to as "B-type viscosity" hereinafter) was coated so as to have a coverage of 10 g/m$^2$ on a solids basis by means of a bar blade coater, dried until the water content in the coated layer was reduced to 5%, and further subjected to calendering treatment under a linear pressure of 20 kg/cm, thereby providing an ink-receiving layer. The thus prepared ink-jet recording material had a basis weight of 190 g/m$^2$. Additionally, the amounts of ingredients (except water) mixed in the following coating Composition (1) are on a solids basis.

Coating Composition (1):

| Coating Composition (1): | |
|---|---|
| Synthetic silica (X-12, trade name, a product of Tokuyama Corp.) | 100 parts |
| Polyvinyl alcohol (PVA 117, trade name, a product of Kuraray Co., Ltd.) | 35 parts |
| Water-soluble magnesium salt (magnesium sulfate heptahydrate (on an anhydrous basis)) | 3 parts |
| Dye fixing agent (PAS-H-10L, trade name, a product of Nitto Boseki Co., Ltd.) | 5 parts |
| Water | 610 parts |

EXAMPLE 2

An ink-jet recording material was prepared in the same manner as in Example 1, except that the amount of water mixed in the coating Composition (1) was increased to 674 parts and thereby the solids concentration and the B-type viscosity were lowered to 17.5 weight % and 1,280 mPa·s respectively.

EXAMPLE 3

An ink-jet recording material was prepared in the same manner as in Example 1, except that the amount of magnesium sulfate heptahydrate and that of water mixed in the coating Composition (1) were decreased to 0.5 parts (on an anhydrous basis) and 599 parts respectively, thereby lowering the B-type viscosity to 1,180 mPa·s as the solids concentration remained at 19 weight %.

EXAMPLE 4

An ink-jet recording material was prepared in the same manner as in Example 1, except that the amount of magnesium sulfate heptahydrate and that of water mixed in the coating Composition (1) were increased to 8 parts (on an anhydrous basis) and 631 parts respectively, thereby raising the B-type viscosity to 4,200 mPa·s as the solids concentration remained at 19 weight %.

EXAMPLE 5

An ink-jet recording material was prepared in the same manner as in Example 1, except that the coverage of the coating Composition (1) was reduced to 6 g/m$^2$ on a solids basis.

EXAMPLE 6

An ink-jet recording material was prepared in the same manner as in Example 1, except that the coverage of the coating Composition (1) was raised to 20 g/m$^2$ on a solids basis.

EXAMPLE 7

An ink-jet recording material was prepared in the same manner as in Example 1, except that the magnesium sulfate heptahydrate used in the coating Composition (1) was replaced by 1 parts of a thickener, Collacral PU85 (trade name, a product of BASF Japan Ltd.) and the amount of water mixed therein was decreased to 601 parts, thereby raising the B-type viscosity to 3,150 mPa·s as the solids concentration remained at 19 weight %.

EXAMPLE 8

An ink-jet recording material was prepared in the same manner as in Example 1, except that the amount of water mixed in the coating Composition (1) was decreased to 407 parts and thereby the solids concentration and the B-type viscosity were raised to 26 weight % and 5,900 mPa·s respectively.

EXAMPLE 9

An ink-jet recording material was prepared in the same manner as in Example 1, except that the magnesium sulfate heptahydrate used in the coating Composition (1) was replaced by a mixture of 0.5 parts (on an anhydrous basis) of magnesium sulfate heptahydrate and 0.5 parts of a thickener, Collacral PU85 (trade name, a product of BASF Japan Ltd.) and the amount of water added was decreased to 601 parts, and thereby the B-type viscosity was lowered to 2,620 mPa·s as the solids concentration remained at 19 weight %.

EXAMPLE 10

An ink-jet recording material was prepared in the same manner as in Example 1, except that the magnesium sulfate heptahydrate used in the coating Composition (1) was replaced by aluminum sulfate octadecahydrate in the same amount (3 parts on an anhydrous basis) and thereby the B-type viscosity was increased to 3,200 mPa·s.

EXAMPLE 11

An ink-jet recording material was prepared in the same manner as in Example 1, except that the magnesium sulfate heptahydrate used in the coating Composition (1) was replaced by sodium thiosulfate pentahydrate in the same amount (3 parts on an anhydrous basis) and thereby the B-type viscosity was decreased to 2,600 mPa·s.

EXAMPLE 12

An ink-jet recording material was prepared in the same manner as in Example 1, except that the magnesium sulfate heptahydrate used in the coating Composition (1) was replaced by potassium thiosulfate trihydrate in the same amount (3 parts on an anhydrous basis) and thereby the B-type viscosity was decreased to 2,580 mPa·s.

EXAMPLE 13

An ink-jet recording material was prepared in the same manner as in Example 1, except that the magnesium sulfate heptahydrate used in the coating Composition (1) was replaced by zinc sulfate heptahydrate in the same amount (3 parts on an anhydrous basis) and thereby the B-type viscosity was decreased to 2,550 mPa·s.

COMPARATIVE EXAMPLE 1

An ink-jet recording material was prepared in the same manner as in Example 1, except that the drawing paper used as base paper was replaced by a business form paper (NPI form, trade name, a product of Nippon Paper Industries Co., Ltd.) having a basis weight of 160 g/m$^2$, a thickness of 200 $\mu$m, a density of 0.80 g/cm$^3$, a surface roughness of 8.00 $\mu$m when measured with PPS under a soft packing condition of 5 kgf/cm$^2$, a surface roughness of 6.40 $\mu$m when measured with PPS under a soft packing condition of 10 kgf/cm$^2$, a center-line average roughness of 2.50 $\mu$m and an Oken-type smoothness of 35 seconds.

COMPARATIVE EXAMPLE 2

An ink-jet recording material was prepared in the same manner as in Example 1, except that the magnesium sulfate heptahydrate was not added to the coating Composition (1) and the amount of water mixed in the Composition (1) were decreased to 597 parts, thereby lowering the B-type viscosity to 490 mPa·s as the solids concentration remained at 19 weight %.

COMPARATIVE EXAMPLE 3

An ink-jet recording material was prepared in the same manner as in Example 1, except that no ink-receiving layer was provided on the drawing paper.

Evaluation results of the ink-jet recording materials prepared in Examples 1 to 13 and Comparative Examples 1 to 3 are shown in Tables 1 and 2. Additionally, the recording materials can be used without any particular problems when graded ◎ to Δ for their performances as shown in Tables 1 and 2.

TABLE 2-continued

| | Dye Ink | | Pigment Ink | | |
|---|---|---|---|---|---|
| | Color reproduction | Ink absorption | Color reproduction | Ink absorption | Note |
| Comparative Example 3 | Δ | X | X | X | |

As can be seen from Tables 1 and 2, the ink-jet recording materials according to the invention, which were each provided with an ink-receiving layer containing pigment and binder as main ingredients and having a rough texture specified by the invention, had good ink absorption and excellent color reproduction, and so they were well suited for forming thereon images like paintings and calligraphic works by ink-jet recording processes.

TABLE 1

| | Additive | Amount added (parts) | Solids concentration (%) | B-type viscosity (cps) | Coverage ($g/m^2$) | Surface Roughness: Visual obsevation | PPS under 5 $kgf/cm^2$ ($\mu m$) | PPS under 10 $kgf/cm^2$ ($\mu m$) | Stylus-type measurement ($\mu m$) | Oken-type Smoothness (sec) |
|---|---|---|---|---|---|---|---|---|---|---|
| Example 1 | $MgSO_4$ | 3 | 19 | 2750 | 10 | ○ | 10.00 | 9.20 | 4.00 | 8 |
| Example 2 | $MgSO_4$ | 3 | 17.5 | 1280 | 10 | ○ | 9.85 | 8.95 | 3.90 | 10 |
| Example 3 | $MgSO_4$ | 0.5 | 19 | 1180 | 10 | Δ | 9.45 | 8.30 | 3.45 | 15 |
| Example 4 | $MgSO_4$ | 8 | 19 | 4200 | 10 | ◎ | 10.30 | 9.45 | 4.30 | 4 |
| Example 5 | $MgSO_4$ | 3 | 19 | 2750 | 6 | ◎ | 10.35 | 9.60 | 4.35 | 3 |
| Example 6 | $MgSO_4$ | 3 | 19 | 2750 | 20 | Δ | 9.60 | 8.45 | 3.60 | 16 |
| Example 7 | PU85 | 1 | 19 | 3150 | 10 | ○ | 9.90 | 9.10 | 4.00 | 9 |
| Example 8 | $MgSO_4$ | 3 | 26 | 5900 | 10 | Δ | 9.25 | 7.50 | 3.05 | 22 |
| Example 9 | $MgSO_4 \cdot PU85$ | 0.5 + 0.5 | 19 | 2620 | 10 | ○ | 9.75 | 8.80 | 3.75 | 12 |
| Example 10 | $Al_2(SO_4)_3$ | 3 | 19 | 3200 | 10 | ○ | 10.05 | 9.25 | 4.00 | 8 |
| Example 11 | $Na_2S_2O_3$ | 3 | 19 | 2600 | 10 | ○ | 9.90 | 9.15 | 4.00 | 9 |
| Example 12 | $K_2S_2O_3$ | 3 | 19 | 2580 | 10 | ○ | 9.90 | 9.15 | 4.00 | 9 |
| Example 13 | $ZnSO_4$ | 3 | 19 | 2550 | 10 | ○ | 9.80 | 8.85 | 3.80 | 11 |
| Compar. Ex. 1 | $MgSO_4$ | 3 | 19 | 2750 | 10 | X | 6.80 | 5.75 | 2.35 | 26 |
| Compar. Ex. 2 | $MgSO_4$ | 0 | 19 | 490 | 10 | X | 8.70 | 6.35 | 2.90 | 22 |
| Compar. Ex. 3 | — | — | — | — | — | ◎ | 10.40 | 10.00 | 4.40 | 2 |

TABLE 2

| | Dye Ink | | Pigment Ink | | |
|---|---|---|---|---|---|
| | Color reproduction | Ink absorption | Color reproduction | Ink absorption | Note |
| Example 1 | ◎ | ○ | ◎ | ○ | |
| Example 2 | ◎ | ○ | ◎ | ○ | |
| Example 3 | ◎ | ○ | ○ | ○ | |
| Example 4 | ◎ | ○ | ◎ | ○ | |
| Example 5 | ○ | ○ | ○ | Δ | |
| Example 6 | ◎ | ◎ | ◎ | ◎ | |
| Example 7 | ○ | ○ | Δ | ○ | |
| Example 8 | ◎ | Δ | ○ | Δ | |
| Example 9 | ◎ | ○ | ○ | ○ | |
| Example 10 | ◎ | ○ | ◎ | ○ | Metallic gloss was produced by printing in dye ink |
| Example 11 | ◎ | ○ | ○ | ○ | |
| Example 12 | ◎ | ○ | ○ | ○ | |
| Example 13 | ◎ | ○ | Δ | ○ | |
| Comparative Example 1 | ◎ | ○ | ◎ | ○ | Texture was not rough |
| Comparative Example 2 | ○ | ○ | X | ○ | |

Moreover, the mixing of a water-soluble metal salt in a coating composition for the present ink-receiving layer enabled achievement of very good ink absorption and color reproduction even in the ink-jet recording with pigment ink. When images from pictures taken with digital camera and the like were printed on the present recording materials by the use of an ink-jet printers, the images printed were successful in producing an atmosphere of paintings.

What is claimed is:

1. An ink-jet recording material having on at least one surface of a base paper at least one ink-receiving layer comprising pigment and binder, said ink-receiving layer having surface roughness parameters (a), (b) and (c) specified below and an Oken-type smoothness of at most 30 seconds when determined according to Japan TAPPI No. 5:

(a) a surface roughness of at least 9.0 $\mu m$, measured with a PARKER PRINT-SURF measurement device under a soft packing condition of 5 $kgf/cm^2$ according to ISO 8791-4:1992, (b) a surface roughness of at least 7.0 $\mu m$, measured with PPS under a soft packing condition of 10 $kgf/cm^2$ according to ISO 8791-4:1992, and (c) a center-line average roughness (Ra) of at least 3.0 $\mu m$, measured with a stylus-type roughness tester according to JIS B0651.

2. An ink-jet recording material as described in claim 1, wherein the ink-receiving layer is a layer formed by coating and drying a coating composition having a solids concentration of at most 25 weight % and a viscosity of at least 1,000 mPa·s when measured with a Brookfield type viscometer according to JIS K7117.

3. An ink-jet recording material as described in claim 2, wherein the coating composition is coated with a blade coater.

4. An ink-jet recording material as described in claim 1, wherein the base paper has surface roughness parameters (a), (b) and (c) specified below and an Oken-type smoothness of at most 30 seconds when determined according to Japan TAPPI No. 5:

(a) a surface roughness of at least 9.0 μm, measured with a PARKER PRINT-SURF measurement device under a soft packing condition of 5 kgf/cm$^2$ according to ISO 8791-4:1992, (b) a surface roughness of at least 7.0 μm, measured with PPS under a soft packing condition of 10 kgf/cm$^2$ according to ISO 8791-4:1992, and (c) a center-line average roughness (Ra) of at least 3.0 μm, measured with a stylus-type roughness tester according to JIS B0651.

5. An ink-jet recording material according to claim 4, wherein the base paper has surface roughness parameters (a), (b) and (c) specified below and an Oken-type smoothness of at most 20 seconds when determined according to Japan TAPPI No. 5:

(a) a surface roughness of 9.3 to 11.0 μm, measured with a PARKER PRINT-SURF measurement device under a soft packing condition of 5 kgf/cm$^2$ according to ISO 8791-4:1992, (b) a surface roughness of 7.7 to 10.9 μm, measured with PPS under a soft packing condition of 10 kgf/cm$^2$ according to ISO 8791-4:1992, and (c) a center-line average roughness (Ra) of 3.2 to 9.0 μm, measured with a stylus-type roughness tester according to JIS B0651.

6. An ink-jet recording material as described in claim 1, wherein the ink-receiving layer further comprises a water-soluble metal salt in an amount of 0.5 to 10 parts by weight per 100 parts by weight of the pigment.

7. An ink-jet recording material as described in claim 6, wherein the water-soluble metal salt is at least one salt selected from the group consisting of aluminum salts, magnesium salts, sodium salts, potassium salts and zinc salts.

8. An ink-jet recording material as described in claim 1, wherein the binder is comprised in a proportion of 5 to 60 parts by weight per 100 parts by weight of pigment.

9. An ink-jet recording material as described in claim 1, wherein the pigment has an oil absorption of 100 to 300 cc/100 g.

10. An ink-jet recording material as described in claim 1, wherein the pigment is a synthetic silica.

11. An ink-jet recording material as described in claim 1, wherein the binder comprises polyvinyl alcohol.

12. An ink-jet recording material according to claim 1, wherein the amount of binder in said at least one ink-receiving layer is 10 to 50 parts by weight per 100 parts by weight of pigment.

13. An ink-jet recording material according to claim 1, wherein the pigment is precipitated calcium carbonate, ground calcium carbonate, kaolin, clay, talc, titanium dioxide, zinc oxide, zinc carbonate, satin white, magnesium carbonate, magnesium silicate, calcium sulfate, calcium silicate, aluminum silicate, aluminum hydroxide, alumina sol, colloidal alumina, alumina, psuedo-boehmite, hydrated alumina, zeolite, silica, or a plastic pigment.

14. An ink-jet recording material according to claim 1, wherein the binder is starch, oxidized starch, esterified starch, enzyme-denatured starch, cationic starch, protein, casein, soybean protein, carboxymethyl cellulose, hydroxyethyl cellulose, a polyvinyl alcohol, an acrylic resin emulsions, a vinyl acetate resin emulsion, a vinylidene chloride resin emulsion, a styrene-butadiene latex, an acrylonitrile-butadiene latex, or a polyester dispersion.

15. An ink-jet recording material according to claim 1, wherein said at least one ink-receiving layer has a coverage ranging from 5 to 25 g/m$^2$.

16. An ink-jet recording material according to claim 1, wherein said at least one ink-receiving layer has a coverage ranging from 6 to 20 g/m$^2$.

17. A method of providing at least one ink-receiving layer comprising pigment and binder on at least one surface of a base paper, comprising forming said at least one ink-receiving layer by coating and drying a coating composition having a solids concentration of at most 25 weight % and a viscosity of at least 1,000 mPa·s when measured with a Brookfield type viscometer according to JIS K7117, wherein said at least one ink-receiving layer having surface roughness parameters (a), (b) and (c) specified below and an Oken-type smoothness of at most 30 seconds when determined according to Japan TAPPI No. 5:

(a) a surface roughness of at least 9.0 μm, measured with a PARKER PRINT-SURF measurement device under a soft packing condition of 5 kgf/cm$^2$ according to ISO 8791-4:1992, (b) a surface roughness of at least 7.0 μm, measured with PPS under a soft packing condition of 10 kgf/cm$^2$ according to ISO 8791-4:1992, and (c) a center-line average roughness (Ra) of at least 3.0 μm, measured with a stylus-type roughness tester according to JIS B0651.

18. A method according to claim 17, wherein the coating composition is coated with a blade coater.

* * * * *